US005600291A

United States Patent [19]

Duchemin et al.

[11] Patent Number: 5,600,291

[45] Date of Patent: Feb. 4, 1997

[54] CONTACTOR DEVICE

[75] Inventors: Jean-Pierre Duchemin, Jouy-le-Moutier; Bruno Jacquet, Saint-Germain-en-Laye; Régis Perrocheau, Jouy-le-Moutier, all of France

[73] Assignee: Schneider Electric SA, Boulogne Billancourt, France

[21] Appl. No.: 542,321

[22] Filed: Oct. 12, 1995

[30] Foreign Application Priority Data

Oct. 17, 1994 [FR] France ..... 94 12450

[51] Int. Cl.[6] ..... H01H 67/02

[52] U.S. Cl. ..... 335/132; 335/202

[58] Field of Search ..... 335/202, 132

[56] References Cited

U.S. PATENT DOCUMENTS 4,356,368 10/1982 Osika ..... 335/132
4,423,399 12/1983 Goodrich .
4,975,739 12/1990 Noda .
5,081,436 1/1992 Nishi et al. ..... 335/132

FOREIGN PATENT DOCUMENTS 0275493 7/1988 European Pat. Off. .
2579369 9/1986 France .

*Primary Examiner*—Lincoln Donovan
*Attorney, Agent, or Firm*—Oblon, Spivak, McClelland, Maier & Neustadt, P.C.

[57] ABSTRACT

An electromagnetic contactor device including an enclosure formed by a base unit and a housing unit assembled together and accommodating the power poles and a solenoid having a coil the body of which has power supply terminals on one side, said enclosure providing between the base unit and the housing unit a housing adapted to receive the power supply terminals, characterised in that the enclosure has symmetrically disposed relative to the first housing a second housing also formed between the base unit and the housing unit and having substantially the same cross-section as the first housing so that it can receive the side of the coil provided with terminals after the coil is turned around, the housing opposite that receiving the terminals being closed off.

11 Claims, 4 Drawing Sheets

CONTACTOR DEVICE

The present invention concerns an electromagnetic contactor device comprising an enclosure formed by a base unit and a housing unit assembled together and accommodating the power poles and a solenoid including a coil the body of which has power supply terminals on one side.

In some prior art contactors the power supply terminals of the coil are disposed on one side only, either the input side or the output side.

The terminals of the coil are usually on the input side of the contactor; in a combination of electrical devices such as a contactor and a thermal overload relay, for example, in which the relay is preferably on the output side of the contactor, the user cannot group the terminals of the coil of the contactor and the terminals of the thermal overload relay together on the same side to facilitate checking them. Consequently, the user has no choice with regard to the disposition of the wiring of the coil.

When a contactor is combined with a circuit-breaker and the respective terminals are coincident in order to interconnect them, the devices form a unit and if the terminals of the coil are on the side facing the circuit-breaker they become inaccessible.

At present the user has no choice with regard to the position of the power supply terminals of the coil at the time of installing the contactor.

A three-pole contactor has on its input and output sides three pole terminals on the exterior of the contactor body and which are regularly spaced across the width of the transverse walls of the body. The two terminals of the coil are positioned so that they are accessible for wiring them, either in the spaces between the terminals or outside the two areas at the ends.

A four-pole contactor has one more terminal than a three-pole contactor on both its input and its output sides, with the result that the terminals are offset relative to the areas of a three-pole contactor. It is therefore impossible to use a coil identical to that of a three-pole contactor since the terminals would not coincide with the available spaces outside the terminals and would therefore be inaccessible for wiring them.

Each type of contactor therefore requires two different coils which is disadvantageous from the economic point of view.

Consequently, an object of the present invention is to provide a contactor switch device having a coil with power supply terminals that can be either on the input side or on the output side of the contactor and with a disposition of the terminals providing easy access to the latter regardless of the type of contactor.

The present invention concerns a contactor in which the enclosure provides between the base unit and the housing unit a housing adapted to receive the power supply terminals, characterised in that the enclosure has symmetrically disposed relative to the first housing a second housing also formed between the base unit and the housing unit and having substantially the same cross-section as the first housing so that it can receive the side of the coil provided with terminals after the coil is turned around, the housing opposite that receiving the terminals being closed off.

This feature enables the coil to be mounted either way around so that the power supply terminals are either on the input side or on the output side of the contactor.

The coil body advantageously has two additional power supply terminals on the same side as said power supply terminals and each of which is electrically connected to one of the other two terminals.

The spacing of the terminals is determined so that one of the two pairs of terminals is accessible when the contactor has three-pole terminals and the second pair of terminals is accessible when the contactor has four-pole terminals.

The provision of two pairs of terminals and the spacing between them provide access to at least two of them for wiring them, whether the contactor is a three-pole contactor or a four-pole contactor. This feature enables the manufacture of a single type of coil.

The invention will now be described in more detail with reference to embodiments given by way of example and shown in the appended drawings, in which.

Figure 1:
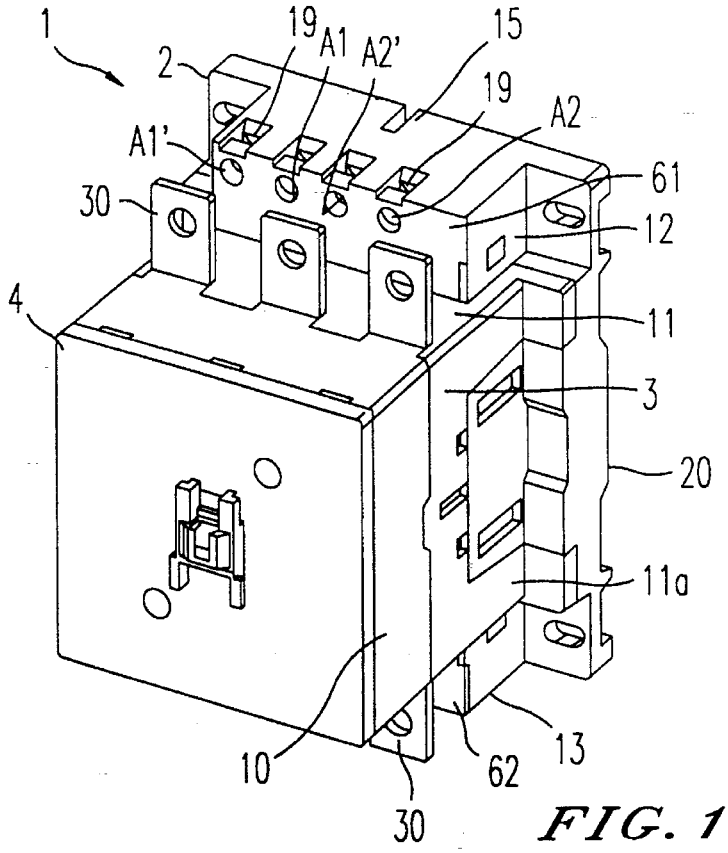
FIG. 1 is a perspective view of a three-pole contactor of the invention.
Figure 3:
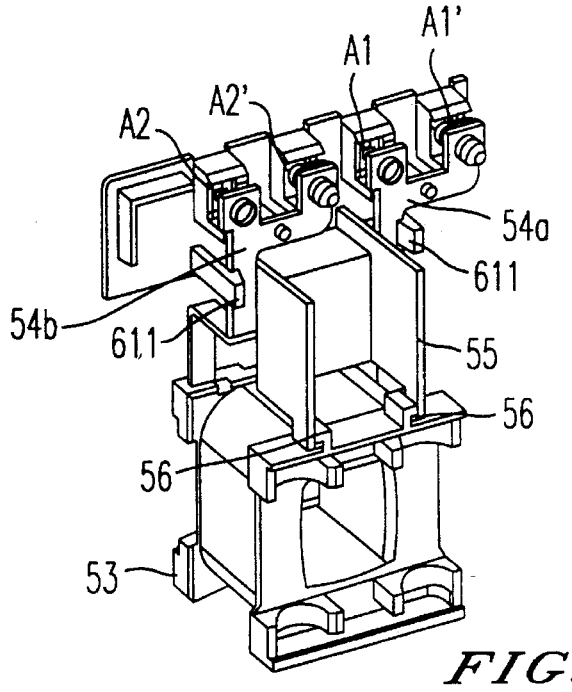
FIG. 3 is a side view of the coil former associated with a terminal cover.

The contactor device 1 shown in FIG. 1 includes an enclosure 10 formed by a base unit 2, a housing unit 3 assembled to the base unit and a cover 4 mounting on top of the housing unit and defining transverse walls 11 and longitudinal walls 11*a*.

The housing unit 3 accommodates power poles each adapted to make or break the current on one line of the contactor. Each pole is of the double contact type and incorporates two fixed contacts that cooperate with two mobile contacts on a contact bridge carried by a contact carrier. The fixed contacts are connected to straight terminals 30 projecting out of the contactor body through openings in the transverse walls 11.

Figure 2:
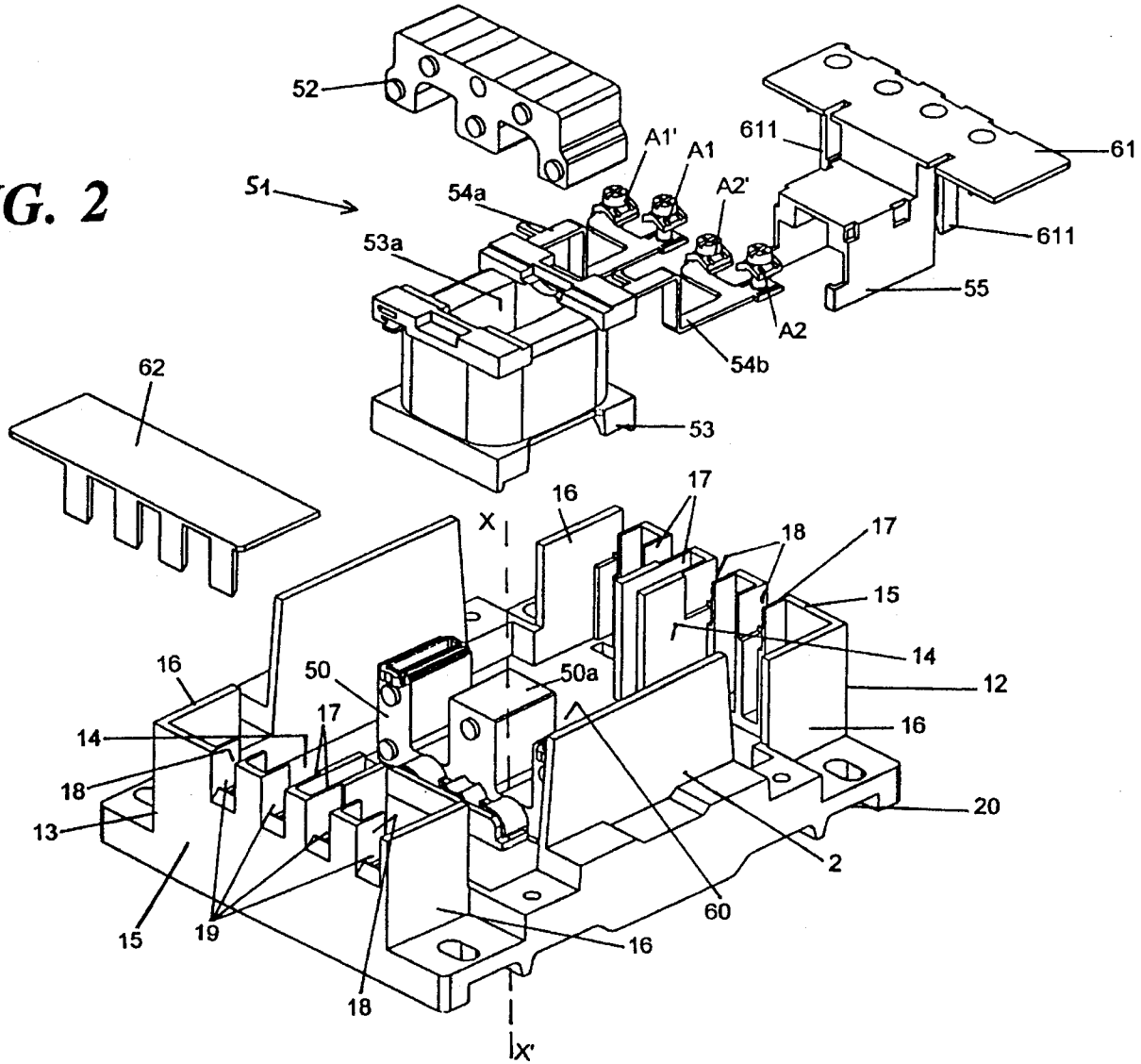
FIG. 2 is an exploded perspective view of the base unit of the contactor including the solenoid.

The base unit 2 has a back plate 20 for fixing the device to a rail. The base unit accommodates a tripping assembly including an actuator solenoid that can be seen in FIG. 2. The actuator solenoid comprises an E-shaped core 50 forming the fixed magnetic circuit, a coil 51 around the central branch 50*a* of the magnetic circuit and connected to a power supply and an E-shaped mobile armature 52 forming the mobile magnetic circuit and mechanically coupled to the contact carrier.

The coil 51 of the solenoid includes a coil former that forms a coil body 53 onto the exterior of which the coil wire is wound. An opening 53*a* in the centre of the coil body enables the coil to be fitted over the central branch 50*a* of the E-shaped fixed magnetic circuit. The coil body carries two parallel conductors 54*a*, 54*b* each carrying respective electrically interconnected power supply terminals A1, A1' and A2, A2' at one end. The other ends of the two conductors are connected to respective ends of the coil wire to energise the coil.

The housing 60 for the coil in the base unit 2 is symmetrical.

A first housing 12 and a second housing 13 with substantially the same cross-section are provided between the base unit and the housing unit, projecting relative to the transverse walls 11 of the contactor enclosure. They are adapted to receive the coil former and in particular the conductors 54*a* and 54*b* carrying the terminals. The symmetrical configuration of the two housings 12 and 13 and of the housing 60 enables the coil to be turned 180° about the axis XX' so that the terminals are either on the input side in the housing 12 or on the output side in the housing 13.

Each of the housings 12 and 13 has an opening 14 at the top, a longitudinal wall 15 and transverse walls 16 at the sides. Partition walls 17 are provided in each housing to form individual chambers 18 for the power supply terminals. Openings 19 in the longitudinal wall 15 give access to the individual chambers 18 to enable insertion of conductor wires into the terminals.

A terminal cover 61 is fitted over the various terminals and closes the opening 14 and partly closes the openings 19 of the housing 12 or 13 receiving the terminals so that only the screws of the terminals A1, A2, A1' and A2' are accessible to the user for insertion of conductor wires.

The terminal cover 61 is attached to a bracket 55 which is removably attached to the coil former by fixtures 56. The sides of the bracket 55 bear against the partition walls 17 of the chambers 18. It has lugs 611 on the bottom the edges of which clip over the conductors 54*a*, 54*b* to retain the conductors mechanically.

A removable solid cover 62 closes off the opening 14 and the openings 19 of the housing 12 or 13 opposite that receiving the terminals in order to bar access to the coil. This cover 62 is fitted over the opening 14 when the contactor enclosure is closed. As an alternative, in the same way as for the cover 61, a bracket removably attached to the coil former can be used to carry the cover 62.

Figure 4:
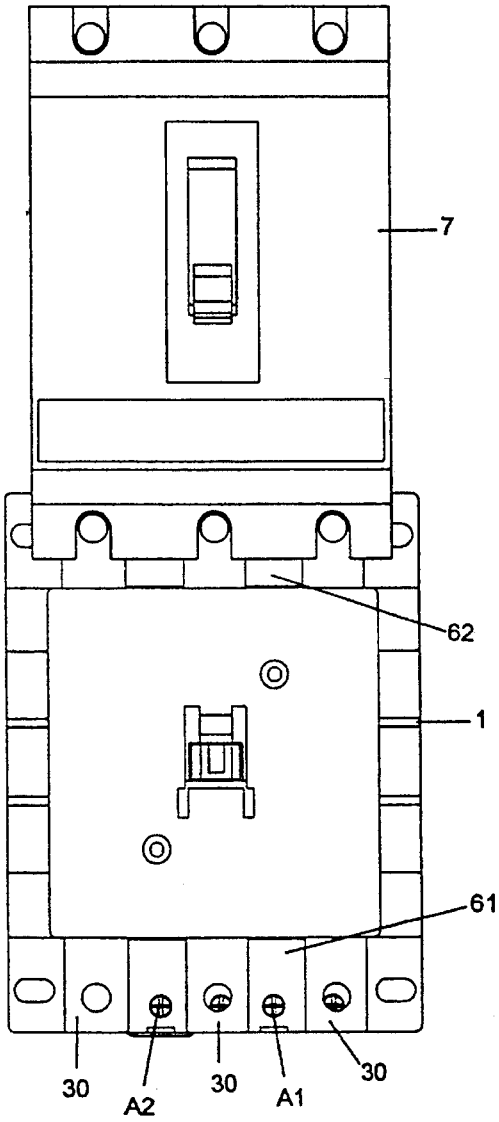
FIG. 4 shows the combination of a three-pole contactor and a circuit-breaker.

FIG. 4 shows the combination of the contactor 1 and a three-pole circuit breaker 7. The terminals of the contactor and the circuit-breaker are connected together and cooperate so that the two devices form a unit. This device therefore prevents access to the coil terminals if these are on the side facing the circuit-breaker. It is then possible to turn the coil around so that the terminals are on the side opposite the circuit-breaker and are therefore accessible, as the figure shows.

Figure 5:
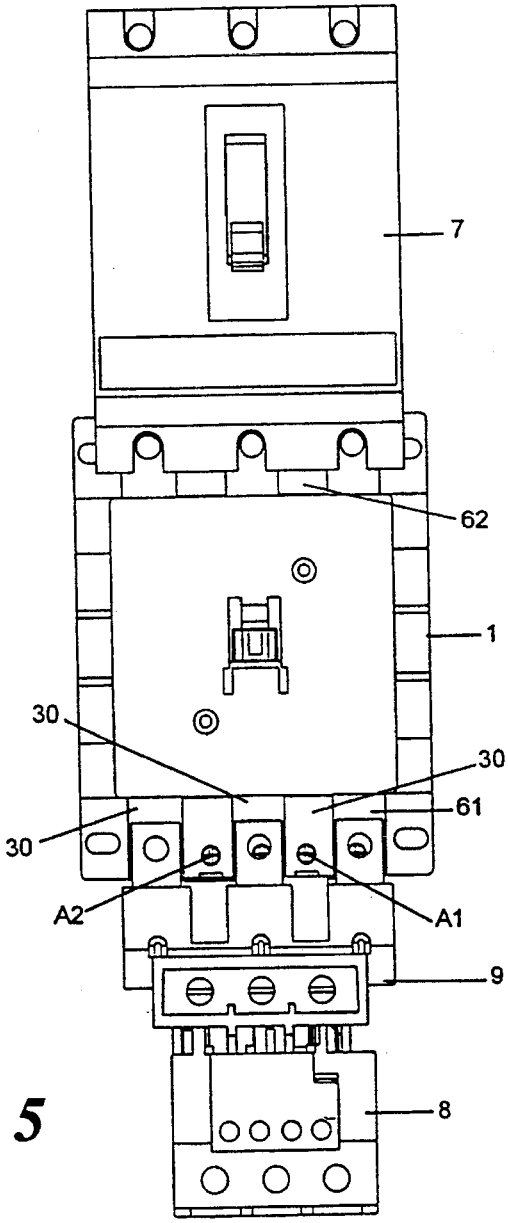
FIG. 5 shows the combination of a three-pole contactor, a circuit-breaker and a thermal overload relay.

FIG. 5 shows the FIG. 4 combination with a thermal overload relay 8 added to it. The relay is on the output side of the contactor with a connection unit 9 providing the electrical connection between the terminals 30 of the contactor and the pins of the thermal protection relay. The connection unit is not in contact with the contactor and there is therefore sufficient space for access to the coil terminals.

Figure 6:
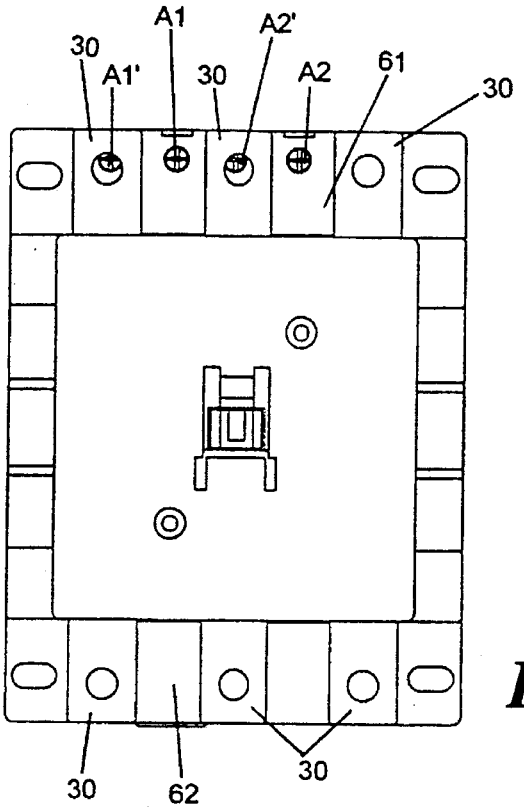
FIG. 6 is a front view of a three-pole contactor.
Figure 7:
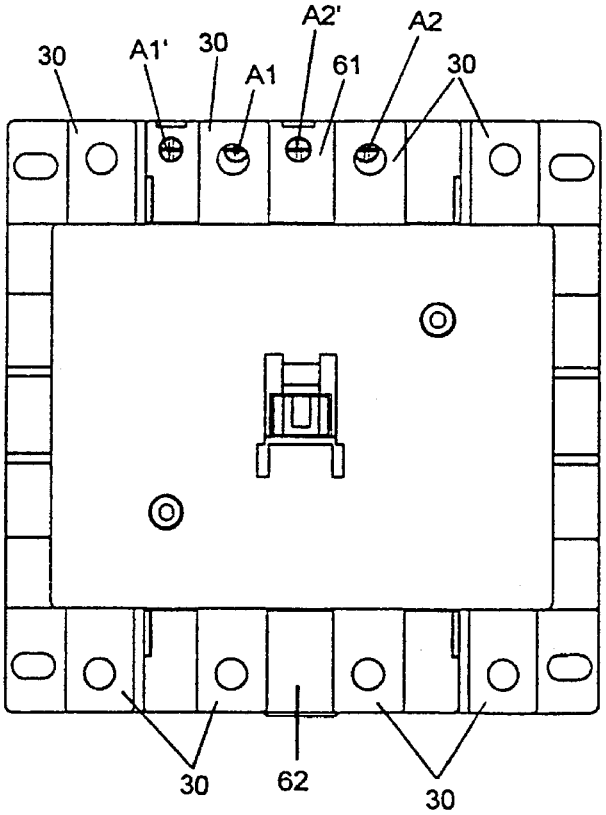
FIG. 7 is a front view of a four-pole contactor.

FIGS. 6 and 7 show a three-pole contactor and a four-pole contactor, respectively. The respective pairs of terminals A1, A2 and A1', A2' provide electrical connection of the coil with two possible positions of the terminals.

For the three-pole contactor the terminals accessible in the spaces between the three terminals are the terminals A1 and A2.

For the four-pole contactor the terminals accessible in the spaces between the terminals are the terminals A1' and A2', the other terminals being partly concealed by the terminals.

We claim:

1. Electromagnetic contactor device including an enclosure formed by a base unit and a housing unit assembled together and accommodating power poles and a solenoid having a coil the body of which has power supply terminals on one side, said enclosure providing between the base unit and the housing unit a first housing adapted to receive the power supply terminals, characterised in that the enclosure has symmetrically disposed relative to the first housing a second housing also formed between the base unit and the housing unit and having substantially the same cross-section as the first housing so that it can receive the side of the coil provided with terminals after a rotation of the coil by 180°, the housing opposite that receiving the terminals being closed off.

2. Contactor device according to claim 1 characterised in that the coil body comprises two additional power supply terminals on the same side as said power supply terminals and each of which is electrically connected to one of the other two terminals.

3. Contactor device according to claim 2 characterised in that the spacing of the terminals is determined so that one of the two pairs of terminals is accessible if the contactor has three-pole terminals and the second pair of terminals is accessible if the contactor has four-pole terminals.

4. Contactor device according to any one of the preceding claims characterised in that the housings project relative to the transverse walls of the enclosure.

5. Contactor device according to claim 2 or claim 3 characterised in that the terminals are at respective ends of two parallel conductors of the coil body.

6. Contactor device according to claim 1 characterised in that each housing has an opening at the top and openings in the longitudinal wall.

7. Contactor device according to claim 6 characterised in that each housing comprises partition walls to form individual chambers that provide access to the openings and in which the terminals fit.

8. Contactor device according to claim 1 characterised in that a removable solid cover is provided for closing off the housing opposite that receiving the terminals.

9. Contactor device according to claim 1 characterised in that a terminal cover is provided for the housing receiving the terminals and is attached to a bracket which is removably mounted on the coil former by means of fixtures.

10. Contactor device according to claims 6, 8 or 9 characterised in that the terminal cover closes off the opening and part of the openings of the housing receiving the terminals and the solid cover closes off the opening and the openings of the housing opposite that receiving the terminals.

11. Contactor device according to claim 9 characterised in that the terminal cover has lugs on the bottom the edges of which clip over the conductors.

* * * * *